US009605505B2

(12) United States Patent
Robichaux et al.

(10) Patent No.: US 9,605,505 B2
(45) **Date of Patent: *Mar. 28, 2017**

(54) METHOD AND APPARATUS FOR PERFORMING CEMENTING OPERATIONS

(71) Applicant: BLACKHAWK SPECIALTY TOOLS, LLC, Houston, TX (US)

(72) Inventors: Ron D. Robichaux, Houma, LA (US); James F. Giebeler, San Bernardino, CA (US); Juan Carlos E. Mondelli, Houston, TX (US)

(73) Assignee: Blackhawk Specialty Tools, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/961,218

(22) Filed: Dec. 7, 2015

(65) Prior Publication Data

US 2016/0102521 A1 Apr. 14, 2016

Related U.S. Application Data

(63) Continuation of application No. 12/657,558, filed on Jan. 22, 2010, now Pat. No. 9,212,531.

(60) Provisional application No. 61/205,650, filed on Jan. 22, 2009.

(51) Int. Cl.

| | |
|---|---|
| ***E21B 33/068*** | (2006.01) |
| ***E21B 33/05*** | (2006.01) |
| ***E21B 33/13*** | (2006.01) |

(52) U.S. Cl.
CPC ..... *E21B 33/068* (2013.01); *E21B 33/05* (2013.01); *E21B 33/13* (2013.01)

(58) Field of Classification Search
CPC ..... E21B 33/05; E21B 33/068; E21B 33/13
See application file for complete search history.

(56) References Cited

U.S. PATENT DOCUMENTS

| | | | | |
|---|---|---|---|---|
| 3,863,716 | A * | 2/1975 | Streich | E21B 33/05 166/70 |
| 4,782,894 | A * | 11/1988 | LaFleur | E21B 33/16 116/298 |
| 9,212,531 | B2 * | 12/2015 | Robichaux | E21B 33/05 |
| 2010/0101792 | A1 * | 4/2010 | Rogers | E21B 17/02 166/285 |
| 2014/0151044 | A1 * | 6/2014 | Robichaux | E21B 17/05 166/285 |

* cited by examiner

*Primary Examiner* — Elizabeth Gitlin
(74) *Attorney, Agent, or Firm* — Ted M. Anthony

(57) ABSTRACT

A remotely operated lifting top drive cement head has a high tensile strength and the ability to swivel or rotate. The cement head permits selective launching of darts, setting plugs, balls or other objects which can be held in place within the cement head without being damaged or washed away by slurry flow, but which can be launched as desired. The cement head can be remotely operated without requiring personnel to be lifted off the rig floor to actuate the tool or observe tool status.

18 Claims, 8 Drawing Sheets

METHOD AND APPARATUS FOR PERFORMING CEMENTING OPERATIONS

CROSS REFERENCES TO RELATED APPLICATIONS

This application is a continuation of U.S. patent application Ser. No. 12/657,558, filed Jan. 22, 2010, currently pending, which claims priority of U.S. Provisional Patent Application Ser. No. 61/205,650, filed Jan. 22, 2009, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a method and apparatus for performing cementing operations in oil or gas wells. More particularly, the present invention pertains to a method and apparatus for performing cementing operations in oil or gas wells using a remotely-operated rotating cement head having a high tensile strength.

2. Brief Description of the Prior Art

Exploration and development of offshore oil and gas reserves can be extremely risky and expensive undertakings. When a fixed platform or other structure is already in place, wells can typically be drilled using a platform-supported drilling rig. However, because of the high cost required to design, fabricate and install fixed structures and associated production facilities and equipment, this investment is often deferred until after the existence of sufficient oil and gas reserves has been proven through exploratory drilling operations. As a result, many offshore wells, particularly exploratory wells and/or wells drilled in deep water environments, are drilled using floating drilling rigs such as drill ships and semi-submersible drilling rigs prior to installation of a permanent platform or other similar structure.

Drilling operations conducted from floating drilling rigs differ from those conducted from permanent structures in many important respects. One important difference is the location of blowout preventer and wellhead assemblies. When drilling from a fixed platform or other similar structure, a blowout preventer assembly is typically located on the platform or other structure. However, when drilling from a floating drilling rig, blowout preventer and wellhead assemblies are not located on the drilling rig, but rather on the sea floor. As a result, specialized equipment known as "subsea" or "subsurface" blowout preventer and wellhead assemblies must be utilized.

Cementing operations are frequently made more complicated by the use of such subsea equipment. In subsea well drilling applications, a cement head is typically installed above the rig floor to provide a connection or interface between a rig's pipe lifting system and surface pumping equipment, on the one hand, and down hole work string or other tubulars extending into a well, on the other hand. Such cement heads must permit cement slurry to flow from a pumping assembly into the well, and should have sufficient flow capacity to permit high pressure pumping of large volumes of cement and other fluids at high flow rates. Such cement heads must also have sufficient tensile strength to support heavy weight tubulars extending from the surface into a well, and to accommodate raising and lowering of such tubular goods. Cement heads should also beneficially swivel in order to permit rotation of the tubular goods and/or other downhole equipment in a well while maintaining circulation from the surface pumping equipment into the down hole tubular goods extending into the well.

Darts, balls, plugs and/or other objects, typically constructed of rubber, plastic or other material, are frequently pumped into a well in connection with conventional cementing operations. In many instances, such items are suspended within a cementing head until the objects are released or "launched" at desired points during the cement pumping process. Once released, such items join the cement slurry flow and can be pumped down hole directly into a well. Such darts, balls, plugs and/or other objects should be beneficially held in place within the slurry flow passing through the cement head prior to being launched or released without being damaged or washed away by such slurry flow.

In many cases, cement heads must be positioned high above the rig floor during cementing operations. In such instances, a cement head will typically be located out of reach of personnel working on the rig floor, making it difficult for such personnel to easily access the cement head in order to actuate valves and/or launch items into the well. Frequently, personnel must be hoisted off the rig floor using a makeshift seat or harness attached to a winch or other lifting device in order to reach the cement head to actuate valves and/or launch darts, balls, plugs or other objects. Such personnel are at risk of falling and suffering serious injury or death. Moreover, such personnel are frequently required to carry heavy bars, wrenches and/or other tools used to manipulate valves or other equipment on such cement heads. These bars, wrenches and/or other heavy tools are at risk of being accidentally dropped on people or equipment on the rig floor below.

Thus, there is a need for a lifting top drive cement head that permits cement flow into the cement head from above, and has a high tensile strength as well as the ability to rotate or swivel. Valves used to isolate or restrict flow through the cement head, as well as launching mechanisms for releasing darts, balls, plugs and/or other objects into the slurry flow, can be remotely actuated from a safe distance to eliminate the need for lifting personnel off the rig floor. Audible and/or visual indicators should also be provided to alert personnel on or in the vicinity of the rig floor about the operation of various elements of the tool and/or the status of objects launched into a well.

SUMMARY OF THE PRESENT INVENTION

The present invention comprises a cement head that can be situated below a top-drive unit, and permits cement to flow through such cement head and into a wellbore below. The cement head of the present invention has a high tensile strength, as well as the ability to swivel or rotate about a central (typically vertical) axis. The present invention also permits the use of darts, setting plugs, balls, wipers and/or other objects which can be held in place within the cement head without being damaged or washed away by cement slurry flow, but which can be beneficially launched or released into said slurry flow at desired points during the cementing process.

The lifting top drive cement head of the present invention generally comprises an upper connection member, lower connection member, and a central body member, each having a central flow bore longitudinally disposed and extending through each such member. Such central flow bores are aligned. A flow-around cage assembly is disposed within the central flow bore of said central body member. At least one remotely actuated control valve is mounted at or near the upper end of said body member, and is used to selectively isolate fluid flow into said central flow bore of said lifting top drive cement head. A torque stabilization device-provides a stable platform to hold the main flow ring/housing in place during rotation of said cement head.

A fluid communication swivel assembly permits fluid communication from a fluid supply/reservoir (such as a hydraulic fluid supply reservoir) to fluid-driven motors that provide power to actuators. The swivel generally permits the cement head of the present invention to rotate without tangling or breaking of hydraulic lines used to supply such fluid to such fluid-driven motors.

At least one observation port or window is provided to permit visual observation of objects (such as darts, setting plugs, wipers or the like) that are suspended in a pre-launch static stage. Additionally, at least one open/close indicator provides a visual display to allow observers (including those at or near the rig floor) to determine whether valves are in the fully open or fully closed positions. Further, in the preferred embodiment, an internal passage indicator is provided. Said indicator can take many forms, but in the preferred embodiment comprises a light emitting device and/or audible tone. Such indicator is provided to signal passage to observers (including those at or near the rig floor) of objects launched such as wiper balls, plugs, darts, trip activation balls, and the like though the central bore of the cement head.

At least one pin pusher, having an override feature is also beneficially provided. Said at least one pin pusher comprises a side-entry extendable pin sub(s) used to push downhole trip activation balls or other objects into the central bore of the cement head. Said pin pushers have an override system that allows for manual operation should a remotely-actuated motor fail to work or should the unit be deliberately used in a manual mode.

At least one pin puller having an override feature is also provided. Each of said at least one pin pullers comprise a side entry retractable pin sub used to suspend darts, wiper balls, plugs and/or the like within the flow around cage assembly until launching of said objects is desired. Each of said at least one pin pullers also have a manual override system that allows for operation of such pin pullers should an automated actuator fail to work, or should the unit be deliberately used in the manual mode.

Accordingly, it is an object of the present invention to provide a remotely operated, rotatable cement head capable of lifting high hook or tensile loads, and having sufficient lifting capacity for subsea drilling applications.

It is a further object of the present invention to provide a cage assembly mounted centrally in a cement head to protect objects within said cage assembly from cement flow from above and angularly around said cage assembly, while permitting remote-controlled launching of said objects at desired points in the cementing process.

It is another object of the present invention to disclose a cement head which has a setting rubber ball held in its side wall and a ball releasing mechanism which does not need to be retracted after operation.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed.

DETAILED DESCRIPTION OF A PREFERRED EMBODIMENT OF THE INVENTION

Figure 1:
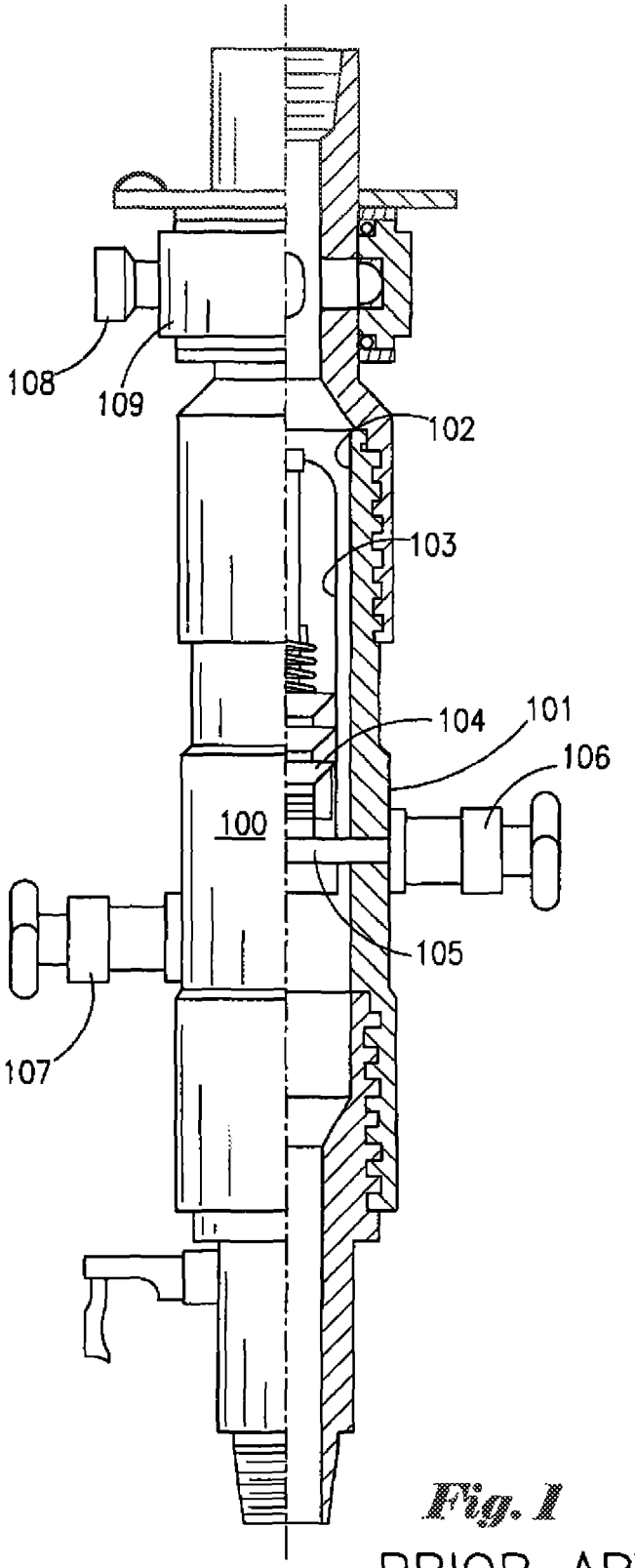
Fig. 1 PRIOR ART
FIG. 1 depicts a side partial cut-away view of a prior art lifting cement head.

FIG. 1 depicts a side, partial cut-away or sectional view of a prior art lifting cement head 100. Prior art lifting cement head 100 generally comprises central body member 101 having a longitudinal bore 102 extending though said central body member 101. Dart cage 103 is disposed within said longitudinal bore 102, and at least one dart 104 is mounted within said dart cage 103. As depicted in FIG. 1, dart 104 rests directly on transverse pin 105. Pin 105 is connected to pin puller assembly 106. Said pin 105 must be manually retracted using pin puller assembly 106 in order to remove support for dart 104 and release said dart 104 into a well below. Prior art lifting cement head 100 may also include ball dropper assembly 107, which may be mounted in a side wall of central body member 101.

In operation, prior art lifting cement head 100 can be mounted in a drilling rig, typically below a top drive device in the manner described above. Cement slurry can be pumped into said cement head 100 via inlet port 108, pass through swivel assembly 109, into central bore 102, past dart cage 103 and, ultimately, into a well situated below said cement head 100. Objects held within dart cage 103, such as dart 104, can be released into such cement slurry and the well below.

While prior art cement head 100 is capable of rotating, all valves associated with said cement head, as well as any dart launching device(s) or ball dropper(s) (such as pin puller assembly 106 and ball dropper assembly 107), must be actuated using physical manipulation. As such, when said prior art cement head 100 is mounted a significant distance above the rig floor, which is frequently the case, personnel must be lifted off the rig floor using a makeshift seat or harness attached to a hoist or other lifting device in order to permit such personnel to physically access said cement head 100 to actuate valves and/or to launch darts, balls, plugs or other items. In such cases, personnel are at risk of falling and suffering serious injury or death, and can accidentally drop wrenches or other heavy tools on people or equipment located on the rig floor below.

Figure 2:
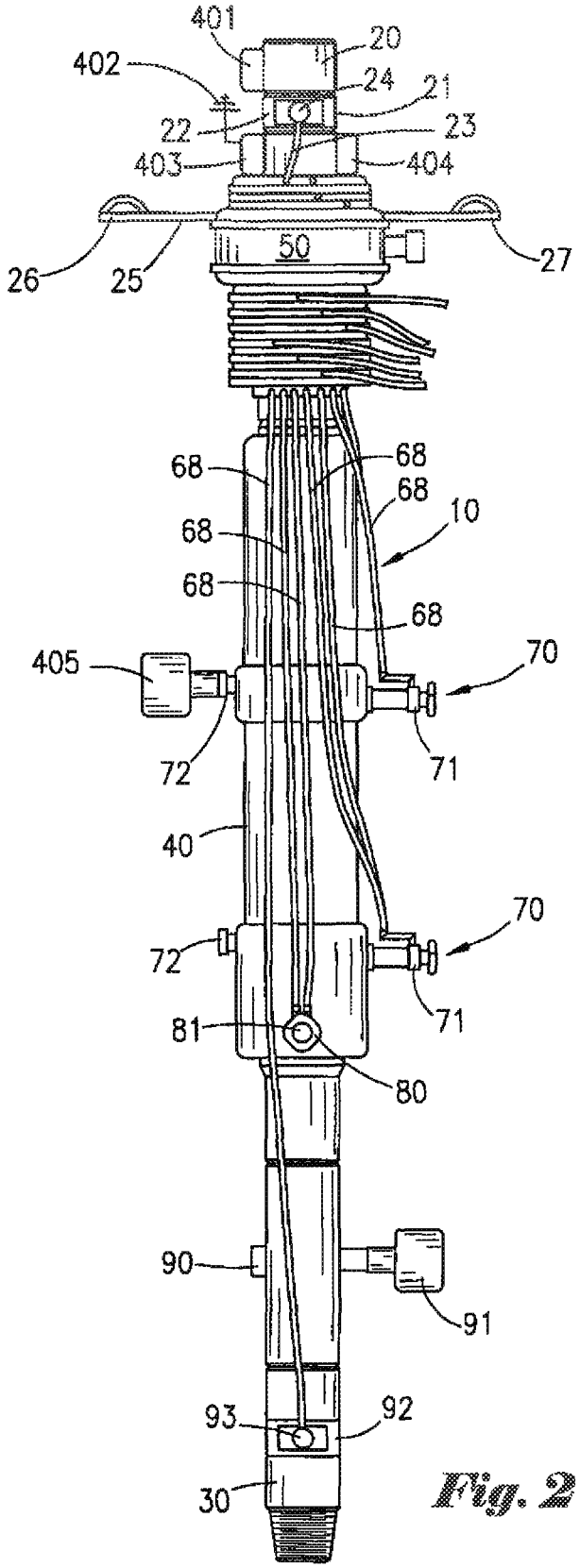
FIG. 2 depicts a side view of the remotely actuated lifting cement head of the present invention.

FIG. 2 depicts a side view of remotely operated lifting cement head 10 of the present invention. Cement head 10 comprises upper assembly or connection member 20, lower assembly or connection member 30, central body member 40 and fluid communication swivel assembly 50. Upper connection member 20 is used to connect cement head 10 (via a lift assembly such as a workstring, pup joint or other connection means) to a top drive unit or other similar device used in drilling operations in a manner that is well known to those having skill in the art. Although other connection means can be used, in the preferred embodiment said upper connection member 20 includes a "box-end" threaded connection. A central bore for fluid flow, not visible in FIG. 2, extends through said upper connection member 20, lower connection member 30, central body member 40 and fluid communication swivel assembly 50, and is substantially aligned with the longitudinal axes of said members. Said central bore provides a flow path for fluids, such as cement slurry, to pass through said lifting cement head 10.

Control valve 21 likewise has a flow bore extending through said valve, and is used to isolate flow into central bore of said lifting cement head 10 via upper connection member 20, such as flow of cement slurry or other fluid pumped into the central bore of upper connection member 20 via a top drive unit. Actuation of said control valve 21 permits closure of said flow bore of valve 21 and selective isolation of cement head 10 from above. Valve actuator 22 can be remotely actuated via hydraulic control line 23, and can selectively open and close valve 21. Valve position indicator 24 is connected to valve 21 to display whether the flow bore of said valve 21 is in the fully open or fully closed position; awareness of said valve position can be essential to prevent equipment damage resulting from flow washout. In the preferred embodiment, said valve position indicator 24 is observable from a significant distance, such as by personnel on or in the vicinity of the rig floor. Torque stabilization device 25 has connection eyelets 26 and 27 for connection of chains or other securing means used to hold cement head 10 in place. Said torque stabilization device 25 is used to provide a stable platform to hold cement head 10 steady while the work string and/or other equipment below rotates.

Fluid communication swivel assembly 50 is provided to permit communication of fluid from a fluid supply/reservoir to fluid driven motors (described below) used to power actuators and/or other devices used for remote operation of cement head 10. As used herein, the term "fluid" is defined broadly to include any substance, such as a liquid or gas, that is capable of flowing and that changes its shape at a steady rate when acted upon by a force tending to change its shape.

Figure 3:
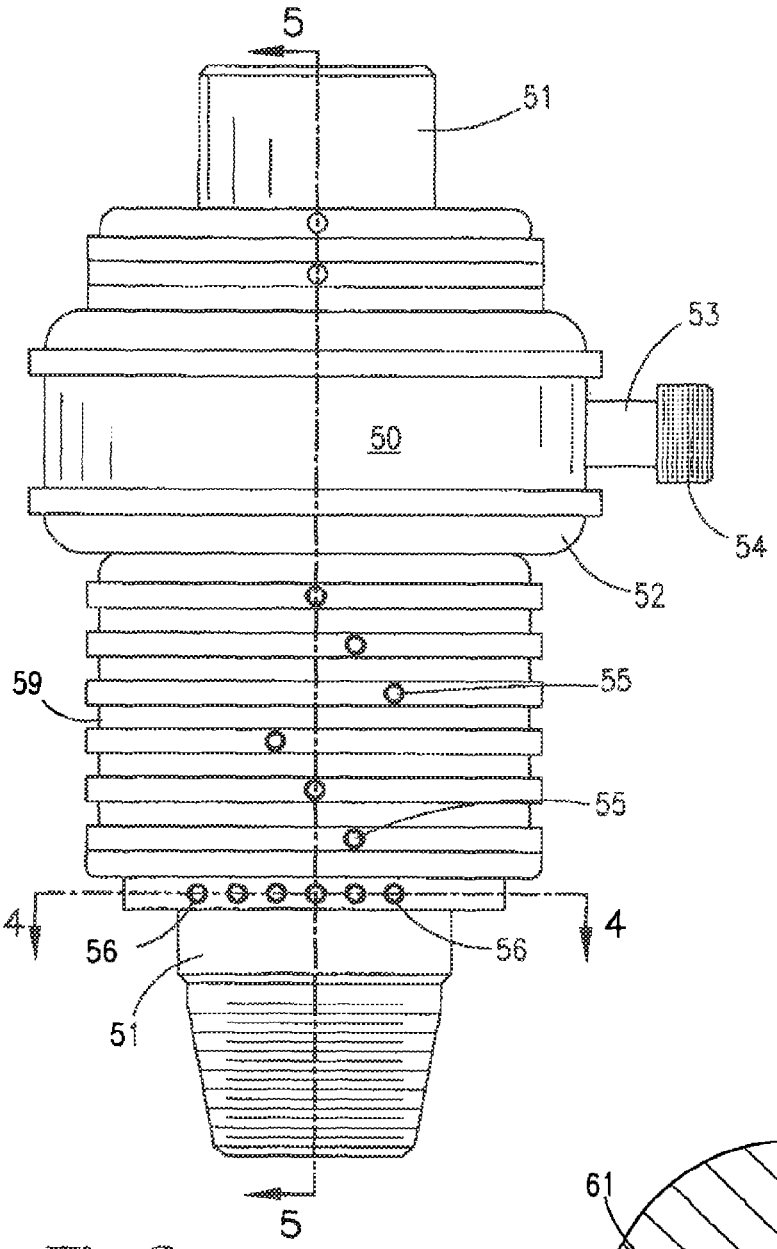
FIG. 3 depicts a side view of a swivel assembly of the present invention.

FIG. 3 depicts a side view of fluid communication swivel assembly 50 of the present invention. Mandrel 51 comprises a substantially tubular body having a central longitudinal bore 61 (not shown in FIG. 3). Mandrel 51 supports flow ring housing 52 having side inlet sub 53 with threaded connection 54. Flow ring housing 52 comprises an outer housing defining a closed system for contained flow of drilling mud, cement, slurry, and/or other fluids into cement head 10 via inlet sub 53. During swivel operations, flow ring housing 52 remains static while mandrel 51 is capable of rotation about its central longitudinal axis. Flow ring housing 52 permits the transfer of fluids pumped into side inlet sub 53 to mandrel 51, even during rotation, via a series sealed chambers and drilled bores described in detail below. Still referring to FIG. 3, a plurality of static ports 55 are provided along the length of fluid communication lower body member 59 assembly. Additionally, a plurality of ports 56 are provided in mandrel 51. In the preferred embodiment, ports 56 are linearly aligned.

Figure 5:
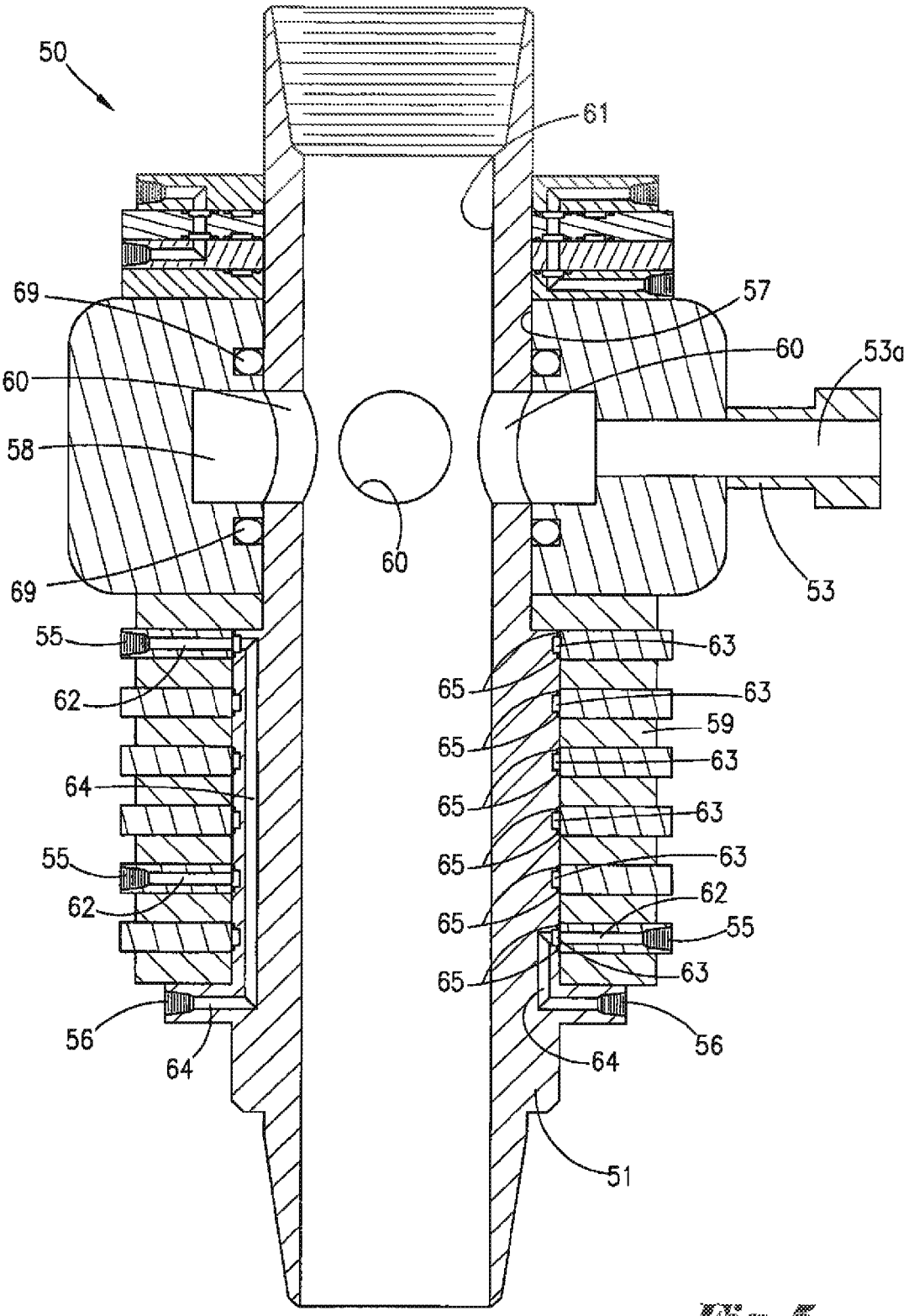
FIG. 5 depicts a sectional view of the swivel assembly of the present invention along line 5-5 of FIG. 3.

FIG. 5 depicts a side sectional view of fluid communication swivel assembly 50 along line 5-5 of FIG. 3. Flow ring housing 52 has central bore 57 and internal chamber 58 in fluid communication with flow bore 53*a* of side inlet sub 53. Mandrel 51 having central bore 61 is received within bore 57 of flow ring housing 52, and is capable of rotating about its longitudinal axis. A plurality of sealing elements 69 are disposed above and below chamber 58, and provide a pressure seal between mandrel 51 and flow ring housing 52. In the preferred embodiment, sealing elements 69 comprise elastomeric seals.

At least one aperture 60 extends through mandrel 51 and permit fluid communication between chamber 58 and central bore 61 of mandrel 51. Fluid (such as, for example, drilling mud or cement slurry) can be pumped through flow bore 53*a* of side inlet sub 53, into chamber 58, through apertures 60, and into central bore 61 of mandrel 51. In this manner, fluid can be pumped through fluid communication swivel assembly 10 when mandrel 51 is static, or when said mandrel 51 is rotating about its central longitudinal axis within flow ring housing 52.

Still referring to FIG.5, fluid communication swivel assembly 50 also facilitates fluid transfer, during static or rotating operations, from a fluid power pump (such as, for example, a hydraulic pump) to fluid-driven motors used to remotely operate the present invention including, without limitation, actuation of said motors.

Hoses or other conduits (not shown in FIG. 5) connect ports 55 with one or more fluid power pumps utilized in connection with lifting cement head 10 of the present invention. In the preferred embodiment, a plurality of transverse bores 62 extend from ports 55 through lower body member 59. A plurality of recessed grooves 63 extends around the outer circumference of mandrel 51; each such recessed groove 63 is aligned with a transverse bore 62. At least one flow tube 64 extends from each such transverse bore 62 through the body of mandrel 51 (substantially parallel to central bore 61 of mandrel 51) and exits mandrel 51; each such flow tube 64 terminates at a bore 56 (which, in the preferred embodiment, may be threaded to accommodate connection of a conventional fitting). Sealing elements 65 are disposed on the sides of each recessed groove 63 in order to provide a fluid seal between fluid communication swivel ring housing 52 and mandrel 51.

Figure 4:
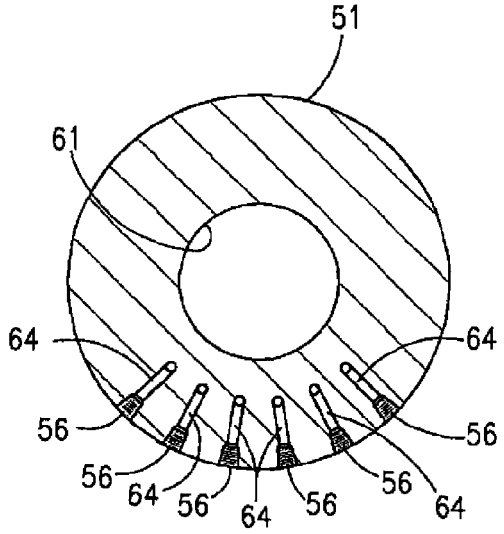
FIG. 4 depicts a sectional view of the swivel assembly of the present invention along line 4-4 of FIG. 3.

FIG. 4 depicts a sectional view of fluid communication swivel assembly 51 along line 4-4 of FIG. 3. Mandrel 51 has central longitudinal bore 61 extending therethrough. A plurality of ports 56 is provided. Each of said ports 56 are connected to a flow tube 64. As depicted in FIG. 5, each of said tubes 64 in turn extends through mandrel 51 a separate isolated recessed groove 63 extending around the outer circumference of mandrel 51. As noted above, each of said recessed grooves in turn, are in fluid communication with a separate transverse bore 62 extending through fluid communication swivel housing 52 and terminating in a static part 55 in lower body member 59 of fluid communication swivel assembly 50. Referring to FIG. 2, a plurality of hoses connect to ports 56 in mandrel 51, and extend to fluid-actuated motors and/or other devices connected to lifting cement head 10.

Referring back to FIG. 2, at least one pin puller assembly 70 is provided. In the preferred embodiment, each of said pin puller assemblies 70 comprises a side-entry retractable pin sub that is used to suspend droppable objects (such as, for example, darts, wiper plugs, balls and the like) within cement head 10. Fluid driven motor 71 is a mechanical device used to power an actuator for said pin puller assembly 70. In the preferred embodiment, observation port 72 is provided and includes a transparent window-like device to visually/physically observe a droppable object being suspended in the pre-drop static stage. This can be especially significant for field personnel that may not have been present during loading of such droppable object. Observation port 72 allows such field personnel to check, inspect, manipulate, record, read and/or test the pre-dropped object on location, which can save rig time by permitting, but not requiring, field-loading of such objects.

Observation port 72 also allows an observer to insert a tool or instrument to manipulate a pre-loaded object, or to deploy objects directly into the device in the field. Observation port 72 also allows for addition of non-ferrous material, whether obscure, semi-obscure, or transparent, for wireless communication and identification of pre-drop object using magnetic, radio frequency, infrared, or any other communication median. Observation port 72 also allows for addition of fluid monitor sensors that can monitor different variables including, without limitation, resistivity, obscuration, reflection, temperature and/or fluid-specific characteristics. Further, said sensors may be used to trigger automated functions with said onboard motors and valves described herein. A manual override system allows for operation of pin puller assembly 70 if the actuator should fail to work or if the unit is deliberately used in the manual mode.

Pin pusher assembly 80 comprises a side-entry extendable pin sub that is used to push objects (including, for example, down hole trip activation balls) into central bore of said lifting cement head 10. A fluid driven motor 81 is a mechanical device used to power an actuator for each pin pusher assembly 80. Pin pusher assembly 80 beneficially has an override system that allows for manual operation of said pin pusher assembly if the actuator should fail to work or if the unit is deliberately used in the manual mode Resetting internal passage indicator 90 is provided to indicate passage of droppable objects used downhole (such as, for example, wiper balls, plugs, darts, trip activation balls, etc.) through the bore of said cement head. In the preferred embodiment, said internal passage indicator 90 provides a signal such as a bright illuminating visual indication and/or a noticeable audible tone. Alternatively, resetting internal passage indicator can comprise a mechanical signaling device, such as a flag, a lever moving up or down, a wheel spinning clockwise or counterclockwise, and/or other visual indicators. Additionally, automated positive passage detection sensor 91 can also be used to indicate passage of objects used downhole (such as, for example, wiper balls, plugs, darts, trip activation balls, etc.) through the bore of said cement head.

Valve 92 is provided having an actuator operated by fluid movement that can selectively open and close said valve 92. Valve 92 can be used to isolate flow through the lower bore, and to/from the well or other items situated below cement head 10. Open/close indicator 93 is provided to display to observer(s) whether the valve 92 is fully open or closed which is essential to mitigate equipment damage from flow washout. In the preferred embodiment, lower connection member 30 has a threaded "pin-end" threaded connection to connect cement head 10 to a workstring, pup joint or any other below item in the string.

Figure 6:
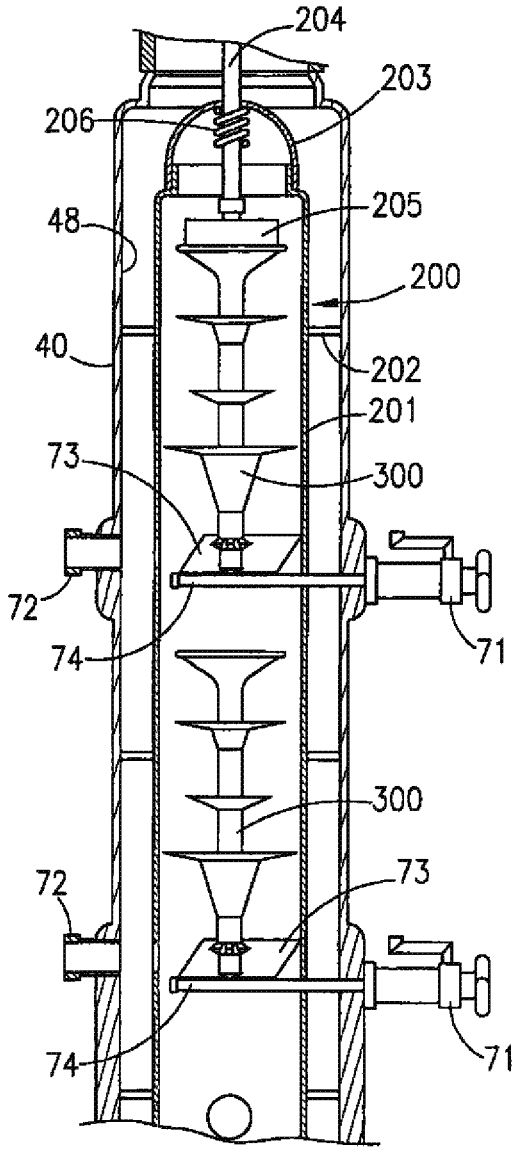
FIG. 6 depicts a side sectional view of a cage assembly of the present invention.
Figure 7:
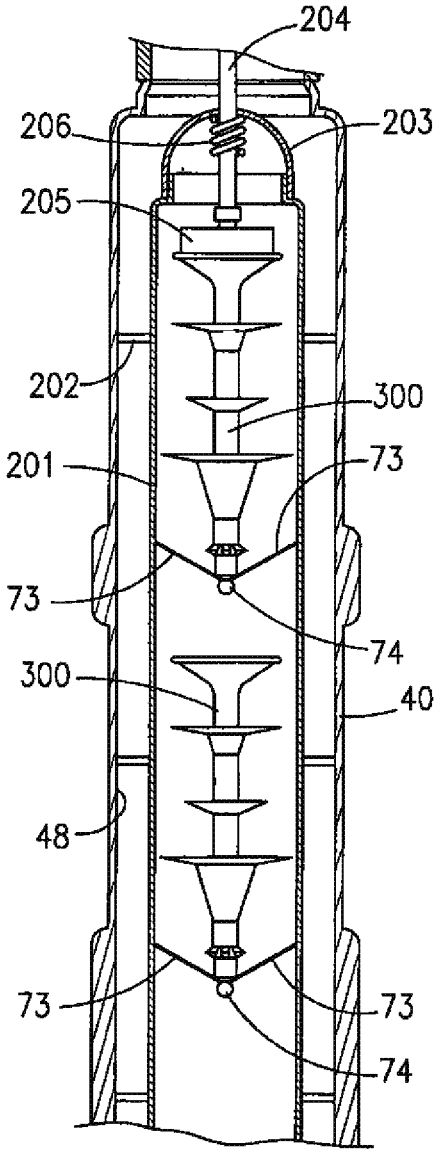
FIG. 7 depicts a front sectional view of a cage assembly of the present invention.

FIG. 6 depicts a side sectional view of a cage assembly of the present invention, while FIG. 7 depicts a front sectional view of a cage assembly of the present invention.

Flow around cage assembly 200 comprises a substantially hollow tubular body 201 that is disposed within central bore 48 of central body member 40. Tubular body 201 is beneficially supported and aligned within central body member 40 using winged centralizer rails 202. Said tubular body 201 is further supported and aligned with the pin puller assembly 70, and observation port 72. Darts 300 are disposed in static state within said tubular body 201.

Said tubular body 201 further comprises top cap 203 that allows some limited flow through said cap and into cage assembly 200. Catapult pole 204 is slidably disposed through a bore extending through said top cap 203. Catapult pole 204 also has a substantially flat disk 205 at its lower end to prevent top damage to darts 300 (or other objects within cage assembly 200), and to prevent lodging of said dart 300 between catapult pole 204 and the inner surface of cage tubular body 201. Biasing spring 206 is provided for energizing catapult pole 204.

Trap door pairs 73 are hinged and suspended/supported by pin 74, which is in turn connected to pin puller motor 71. When launching of dart 300 is desired, pin puller motor 71 is actuated to retract pin 74. In such case, trap door pair 73 is permitted to open, thereby allowing passage of suspended objects such as darts 300. The aforementioned apparatus prevents/reduce pre-mature launching of an object around pin 74, and/or lodging of the head bypass (leading surface) of dart 300 between pin 74 and inner surface of cage tubular body 201. Pin 74 provides a stable and reliable platform to suspend trap door pairs 73 that in turn support/retain the pre-dropped dart 300. Said trap door pairs also act to cup and retain the pre-dropped dart 300 to prevent premature launch of said dart 300 and also reduce the chance for bypass around the pin during high or turbulent flow.

FIG. 7 depicts a front sectional view of a cage assembly of the present invention showing the head of pin 74. Both doors of trap door pairs 73 rest upon pin 74 prior to retracting said pin 74 (using pin puller motor 71) and opening trap doors 73.

Figure 8:
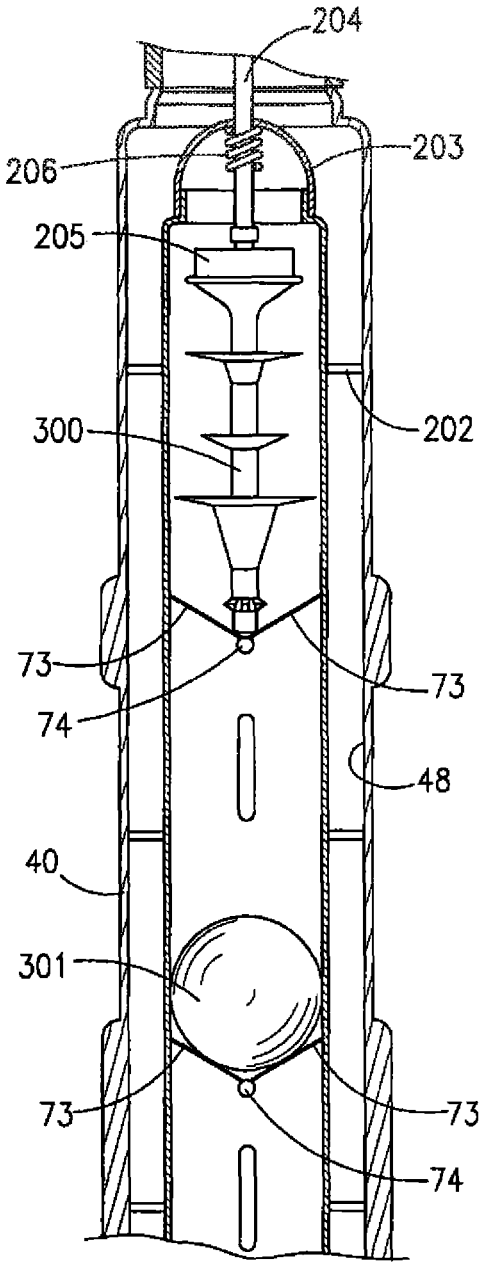
FIG. 8 depicts a front sectional view of a cage assembly of the present invention.

FIG. 8 depicts a front sectional view of an alternate embodiment of cage assembly of the present invention. Flow around cage assembly 200 comprises a substantially hollow tubular body 201 defining an internal space that is disposed within central bore 48 of central body member 40. Tubular body 201 is beneficially supported and aligned within central body member 40 using winged centralizer rails 202. Said tubular body 201 is further supported and aligned with the pin puller assembly 70, and observation port 72. Dart 300 and spherical ball 301 are disposed in static state within said tubular body 201.

Said tubular body 201 further comprises top cap 203 that allows some limited flow through said cap and into cage assembly 200. Catapult pole 204 is slidably disposed through a bore extending through said top cap 203. Catapult pole also has a substantially flat disk 205 at its lower end to prevent top damage to darts 300, and to prevent lodging of a dart 300 between catapult pole 204 and the inner surface of cage tubular body 201.

Trap door pairs 73 are hinged and suspended/supported by pin 74, which is in turn connected to pin puller motor 71. When launching of spherical ball 301 or dart 300 is desired, pin puller motor 71 is actuated to retract pin 74. In such case, trap door pair 73 is permitted to swing open, thereby allowing passage of suspended objects (such as darts 300) free downward movement. The aforementioned apparatus prevents/reduce premature launching of an object around pin 74, and/or lodging of the head bypass (leading surface) of dart 300 between pin 74 and inner surface of cage tubular body 201. Pin 74 provides a stable and reliable platform to suspend trap door pairs 73 that in turn support/retain the pre-dropped dart 300 or spherical ball 301.

Referring back to FIG. 2, an optional alternator device 401 is provided to convert local mechanical or external energy to electrical energy for onboard power source. Examples are (fluid energy, mechanical rotation, wave energy, solar, sterling engine temperature difference, etc.). Wireless communication device 402 is provided to transfer controller information and directions to and from the tool to rig floor, and vice versa. Onboard controller 403 is provided for taking in wireless communication signals and transferring such signals to mechanical devices of the present invention. Said device can also facilitate communication with telemetry devices and recording operations. Onboard fluid switch 404 is provided for acquiring signals from the controller and diverting fluid to the onboard motors, valves, and other equipment. Non ferrous material is used to withstand internal pressures, yet providing a clear nonmetallic path for wireless communication. Pre-drop communication device 405 is able to read and identify type of object situated within cage assembly 200 inside central body member 40. Automated positive passage detection sensor 91 is provided to register passage of an object passing within cement head 10 (such as an object being dropped from cage assembly 200), and is capable of communicating via non ferrous material.

Figure 9:
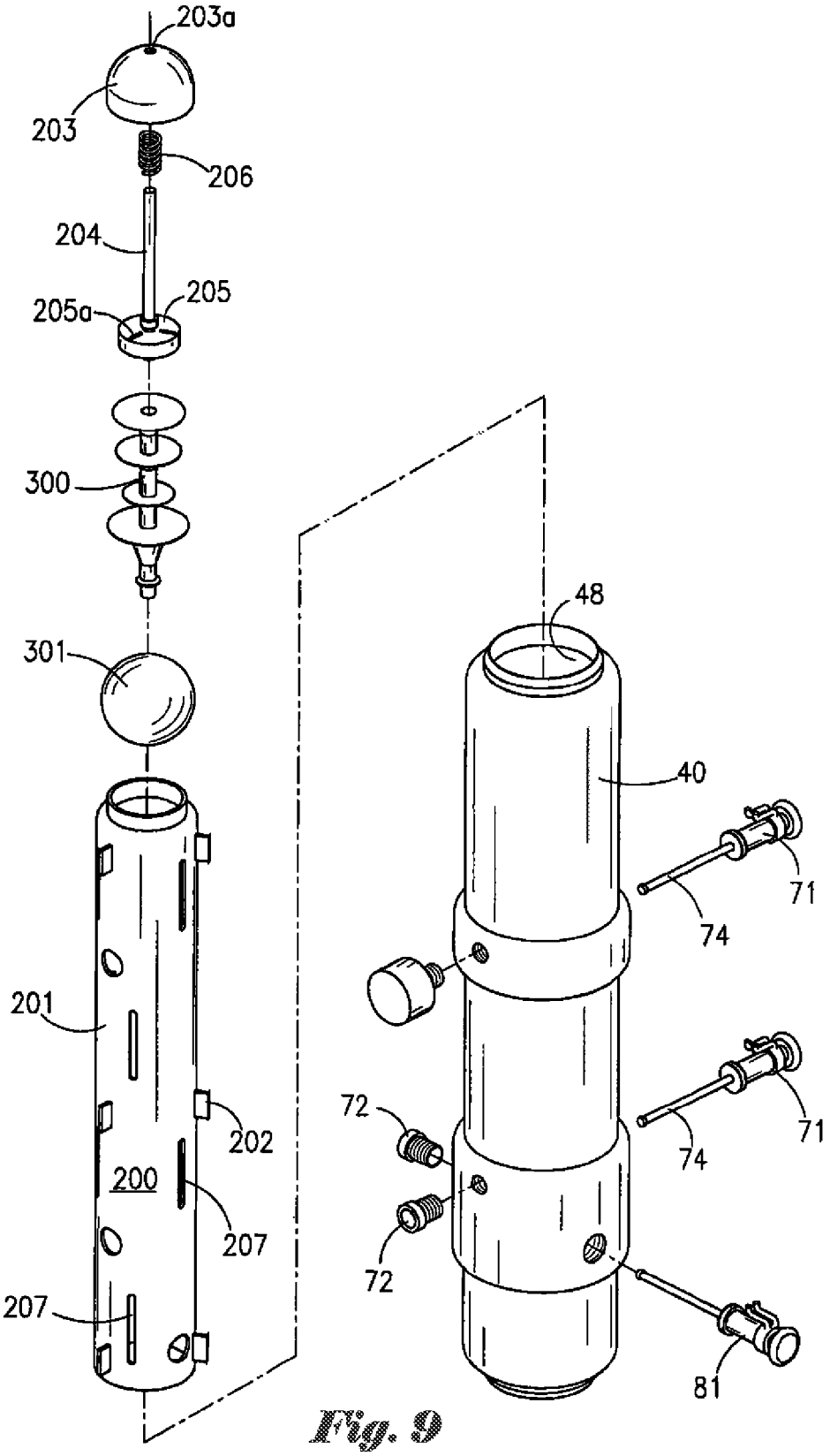
FIG. 9 depicts an exploded perspective view of dropping mechanism of the present invention.

FIG. 9 depicts an exploded perspective view of dropping mechanism of the present invention. Flow around cage assembly 200 comprises a substantially hollow tubular body 201 having a plurality of flow ports 207 that is received and mounted within central bore 48 of central body member 40. Tubular body 201 is beneficially supported and aligned within central body member 40 using winged centralizer rails 202. Said tubular body 201 is further supported and aligned with the pin puller assemblies 70, and observation ports 72. Dart 300 and spherical ball 301 can be loaded and disposed in a static state within said tubular body 201.

Said tubular body 201 further comprises top cap 203 that allows some limited flow through said cap and into cage assembly 200. Catapult pole 204 is slidably disposed through bore 203*a* extending through said top cap 203. Catapult pole 204 also has a substantially flat disk 205 at its lower end to prevent top damage to dart 300 (or other objects within cage assembly 200), and to prevent lodging of said dart 300 between catapult pole 204 and the inner surface of cage tubular body 201. Biasing spring 206 is provided for energizing catapult pole 204.

Catapult pole 204 acts as the main base of the object launching catapult system. In the preferred embodiment, a form preservation knob protruding from the lower side of disk 205 and fits into the most upper fin/cone of dart 300 or like object that is to be dropped; said form preservation knob prevents fin deformity; if not present the fin could be flatted down by the spring energized catapult which could cause the object to experience undesirable operating conditions such as fluid bypass, fluid being the main vehicle used to deliver the object down the well bore. Flow slots 205*a* provide a higher fluid volume velocity during the displacement phase post object deployment down the well bore.

Catapult pole 204 assists in object launch, in case of low fluid flow, with a manual cocked-and-loaded spring 206. Catapult pole 204 increases velocity of an object being launched and moves such object into the flow path. Disk 205 substantially fills the internal diameter of tubular body 201, but has free, reciprocating movement which prevents the top of a pre-dropped object from moving upward and attempting to move by catapult pole 204 that could cause lodging of said object between catapult pole 204 and the inner surface of tubular body 201 as a result of upward/reverse flow or downward plunging during the activation of the catapult mechanism.

Figure 10:
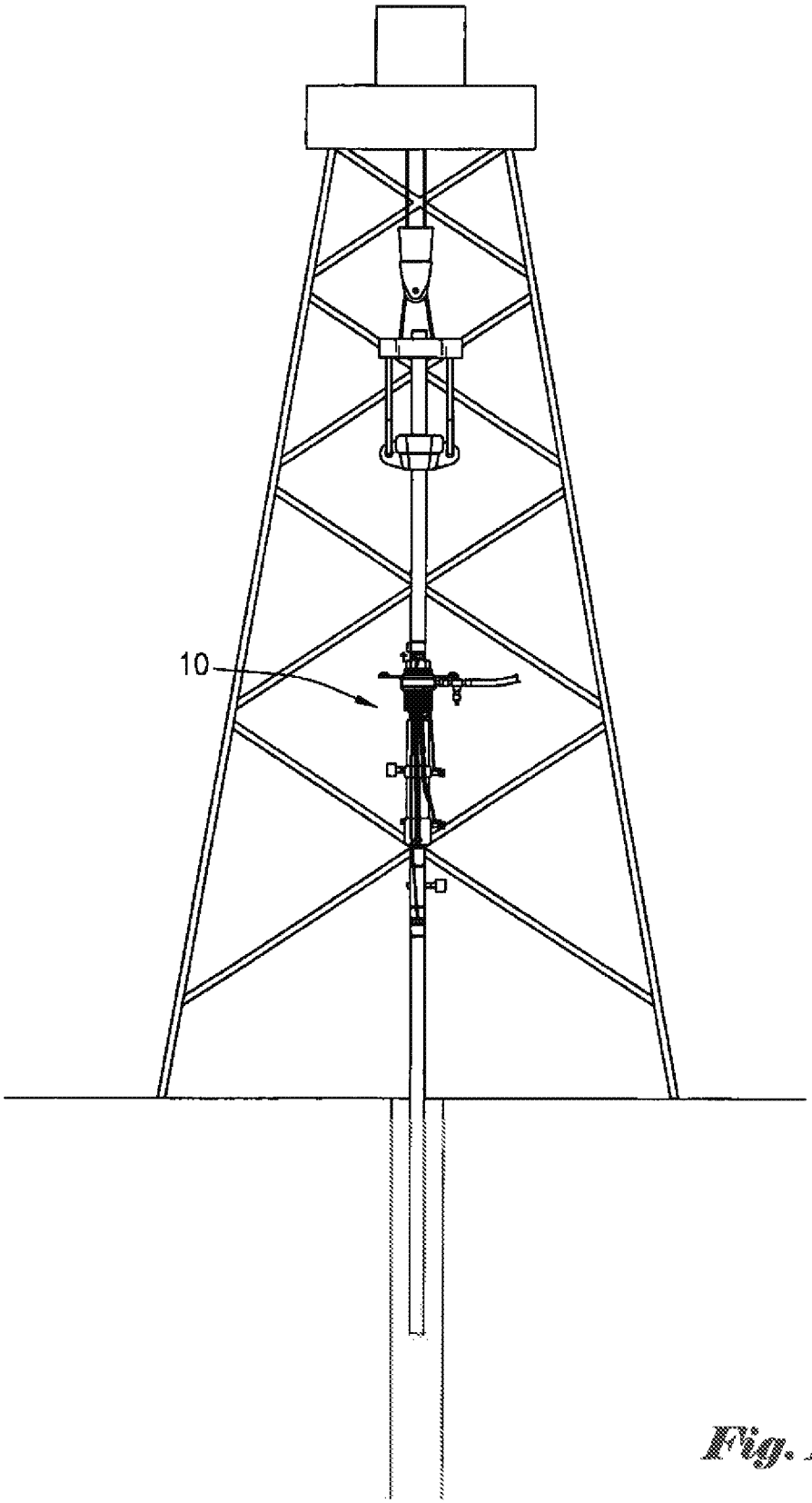
FIG. 10 depicts a sectional view of the lifting cement head of the present apparatus utilized in connection cementing operations on a drilling rig.

FIG. 10 depicts a sectional view of the lifting cement head 100 of the present apparatus utilized in connection cementing operations on a drilling rig. Cement head assembly 100 is provided, either with or without a main flow swivel or side entry sub, and connected to a top drive assembly of a drilling rig. In the preferred embodiment of the present invention, a remote controlled valve is at the upper part of the assembly in line with the work string, adjacent is a remote transfer device for fluid communication. At least one remote controlled release mechanism and ball drop mechanism that are provided. A self-resetting tattletale device alerts operators that an object has passed thru the lower sub and is traveling down hole. At least one remote controlled valve is provided at or near the lower extent of cement head assembly 100.

As set forth in detail above, components of cement head assembly 100 that require movement or actuation can be beneficially operated using a remote control system. In the preferred embodiment of the present invention, such remote control system comprises a series of fluid communication hoses/lines. However, it is to be observed that other means of remote control can be utilized including, without limitation, fiber optics, infrared, sound waves, radio frequency, blue tooth technology, laser, ultrasound, pressure pulses, magnetic and/or other remote control technology. Further, control and monitoring can be accomplished by fluid pulses, hydraulic pressures, wave pulses, ultrasonic pulses or acoustic waves.

Valves that require or are expected to be fully open or fully closed during operation beneficially include indicators to signal whether such valves are in a fully open or fully closed position. Electronic or mechanical monitoring devices can be used to monitor multiple variables during operation of cement head assembly 100, such as force/torque on the assembly, heat, pressure, rotations, RPM, and/or other beneficial data.

Cement head 100 may also beneficially permit the conversion of mechanical energy (by way of illustration, but not limitation, from fluid flow, tool movement or rotation) into electrical energy for use as an onboard power source. Further, said onboard power source may be derived from external elements such as solar power, wave energy, or wind power.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A cement head comprising:

a) a body member having a central flow bore;

b) a cage assembly mounted within said flow bore, said cage assembly defining an internal space;

c) a droppable object releasably disposed within said internal space of said cage assembly;

d) a port extending through said body member adjacent to said cage assembly; and e) a transparent window disposed over said port adapted to permit visual observation of said droppable object disposed within said cage assembly.

2. The cement head of claim 1, further comprising a swivel assembly adapted to permit rotation of said body member.

3. The cement head of claim 2, wherein said swivel assembly further comprises a central flow bore that is in fluid communication with said flow bore of said body member.

4. The cement head of claim 1, further comprising a remotely actuated valve disposed above said swivel assembly.

5. The cement head of claim 1 further comprising a passage indicator below said central body member.

6. The cement head of claim 5, wherein said passage indicator is adapted to generate a signal when said droppable object passes said passage indicator.

7. A method of performing cementing operations comprising:

a) connecting a cement head to a top drive assembly, said cement head comprising:

i) a body member having a central flow bore;

ii) a cage assembly mounted within said flow bore, said cage assembly defining an internal space;

iii) a droppable object releasably disposed within said internal space of said cage assembly;

iv) a port extending through said body member adjacent to said cage assembly; and v) a transparent window disposed over said port adapted to permit visual observation of said droppable object disposed within said cage assembly;

b) pumping cement slurry through said cement head into a well; and c) launching said droppable object into said well.

8. The method of claim 7, wherein said cement head further comprises a puller assembly adapted to selectively retain said droppable object within said cage assembly.

9. The method of claim 8, further comprising the step of remotely actuating said puller assembly to launch said droppable object.

10. The method of claim 7, further comprising the steps of:

a) sensing when a launched object has passed said cement head; and b) signaling when said launched object has passed said cement head.

11. The method of claim 7, wherein said cement head further comprises a swivel assembly adapted to permit rotation of said body member.

12. The method of claim 11, wherein said swivel assembly further comprises a central flow bore that is in fluid communication with said flow bore of said body member.

13. The method of claim 7, wherein said cement head further comprises a remotely actuated pin pusher assembly operationally attached to a side wall of said body member.

14. The method of claim 13, wherein said pin pusher assembly comprises a ball and at least one extendable pin, wherein said at least one extendable pin does not extend into said bore of said body member after said ball is launched.

15. The method of claim 7, wherein said cement head further comprises a passage indicator disposed below said central body member.

16. The method of claim 15, wherein said passage indicator is adapted to generate a signal when said droppable object passes said passage indicator.

17. The method of claim 7, wherein said cement head further comprises a valve disposed above said swivel assembly.

18. The method of claim 17, wherein said valve can be remotely actuated.

* * * * *